US010197295B2

(12) United States Patent
Crespo-Calero

(10) Patent No.: US 10,197,295 B2
(45) Date of Patent: Feb. 5, 2019

(54) HIGHLY EFFICIENT AND EASY TO SERVICE AIR CONDITIONING CONDENSER UNIT

(71) Applicant: Omar Crespo-Calero, Boynton Beach, FL (US)

(72) Inventor: Omar Crespo-Calero, Boynton Beach, FL (US)

( * ) Notice: Subject to any disclaimer, the term of this patent is extended or adjusted under 35 U.S.C. 154(b) by 16 days.

(21) Appl. No.: 15/225,324

(22) Filed: Aug. 1, 2016

(65) Prior Publication Data

US 2017/0030597 A1 Feb. 2, 2017

Related U.S. Application Data

(60) Provisional application No. 62/198,863, filed on Jul. 30, 2015.

(51) Int. Cl.

| | |
|---|---|
| ***F24F 1/22*** | (2011.01) |
| ***F24F 13/20*** | (2006.01) |
| ***F24F 11/30*** | (2018.01) |

(52) U.S. Cl.

CPC ..... *F24F 1/22* (2013.01); *F24F 11/30* (2018.01); *F24F 13/20* (2013.01); *F24F 2013/202* (2013.01); *F24F 2221/02* (2013.01); *F24F 2221/22* (2013.01)

(58) Field of Classification Search

CPC ..... F24F 1/22; F24F 13/20; F24F 2013/202; F24F 2013/205; F24F 2013/242; F24F 2221/02; F24F 2221/32; F24F 11/0086; F24F 11/0091; F25B 2400/36

USPC ..... 62/125

See application file for complete search history.

(56) References Cited

U.S. PATENT DOCUMENTS

| | | | | |
|---|---|---|---|---|
| 2,478,137 A * | 8/1949 | Timmer | F25D 23/006 | 62/295 |
| 2,948,498 A | 8/1960 | Johnsen et al. | | |
| 3,230,733 A * | 1/1966 | Rutishauser | F25D 19/02 | 62/256 |
| 3,819,244 A * | 6/1974 | Paulick | F24F 13/20 | 62/262 |
| 3,866,867 A * | 2/1975 | LaRocca | F24F 13/20 | 62/448 |
| 4,109,708 A | 8/1978 | Imral | | |
| 4,394,111 A * | 7/1983 | Wiese | F24F 13/20 | 165/122 |
| 4,891,017 A * | 1/1990 | Kuhn | H01R 13/6272 | 439/380 |
| 5,582,026 A | 12/1996 | Barto, Sr. | | |
| 6,099,267 A | 8/2000 | Ames et al. | | |

(Continued)

*Primary Examiner* — Jianying Atkisson
*Assistant Examiner* — Tavia Sullens
(74) *Attorney, Agent, or Firm* — Robert M. Downey, P.A.

(57) ABSTRACT

A condenser unit for an air conditioning system includes LED illumination that changes color to indicate status of operation. A lid, front and side panels of the condenser unit are hinged and can be easily opened to allow full access to clean the condenser coil and service the unit. Service valves for liquid and suction lines are conveniently located on the back exterior of the unit for easy access. A fan bracket allows for easy removal and replacement of the fan motor. A sliding compressor plate, aided by ball bearing rollers, enables easy and unobstructed access to the compressor for service and replacement. Internal hoses have quick release fittings that can be released by hand without the need for special tools.

6 Claims, 17 Drawing Sheets

(56) References Cited

U.S. PATENT DOCUMENTS

| | | | | |
|---|---|---|---|---|
| 6,186,158 | B1 | 2/2001 | Goarin | |
| 6,519,970 | B1 | 2/2003 | Rafalovich et al. | |
| 6,662,588 | B2 | 12/2003 | Houk et al. | |
| 7,104,793 | B2 * | 9/2006 | Senn | A61C 19/004 362/373 |
| 7,263,852 | B2 | 9/2007 | Bacchus | |
| 2003/0076763 | A1 * | 4/2003 | Huang | G11B 33/02 720/657 |
| 2007/0137224 | A1 | 6/2007 | Atchison et al. | |
| 2008/0083239 | A1 | 4/2008 | Meyer | |
| 2013/0011537 | A1 * | 1/2013 | Vahid | A47J 27/13 426/523 |
| 2013/0219942 | A1 | 8/2013 | Thomas et al. | |
| 2014/0232249 | A1 * | 8/2014 | White | F24F 1/58 312/215 |

* cited by examiner

HIGHLY EFFICIENT AND EASY TO SERVICE AIR CONDITIONING CONDENSER UNIT

This Non-Provisional Patent Application is based on Provisional Patent Application No. 62/198,863 filed on Jul. 30, 2015.

BACKGROUND OF THE INVENTION

Field of the Invention

The present invention relates to a condenser unit for an air conditioning system and, more particularly, to an outdoor condenser unit that allows for easy access to the compressor, fan motor and coils for facilitating efficient service, cleaning and repairs.

Discussion of the Related Art

Most central air conditioning systems for residential and smaller commercial locations use a split system that has an air handler unit and a separate condenser unit. The air handler unit is typically located within the interior of a home or building, and the corresponding condenser unit is placed at an exterior location, such as a rooftop or ground slab. The condenser unit has a number of components, including a compressor, a condenser coil and a fan with a motor near a top of the unit. The components of the condenser unit are contained within a housing that has four sides, a floor and a top. The sides and top are vented to allow for airflow over the coil and out through the top as a result of operation of the exhaust fan, to thereby release heat from the refrigerant traveling through the condenser coil. Existing designs of condenser units are known to be difficult to access for purposes of service and repair. The poor access to components, as well as difficulty in removing and replacing components, requires considerable time when servicing and repairing condenser units. This not only frustrates service personnel, but also increases the cost to the customer.

Accordingly, there remains a need for a more efficient and service friendly design of condenser units that are typically used in a split system design of central air conditioning systems.

SUMMARY OF THE INVENTION

The present invention is directed to a condenser unit for an air conditioning system. The condenser unit includes LED illumination that changes color to indicate status of operation. A lid, front and side panels of the condenser unit are hinged and can be easily opened to allow full access to clean the coils, make repairs and service the unit. Service valves for liquid and suction lines are conveniently located on the back exterior of the unit for easy access. A fan bracket includes a motor socket that allows for easy removal and replacement of the fan motor. A sliding compressor plate, aided by ball bearing rollers, enables easy and unobstructed access to the compressor for service and replacement. Internal hoses have quick release fittings that can be released by hand without the need for special tools.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
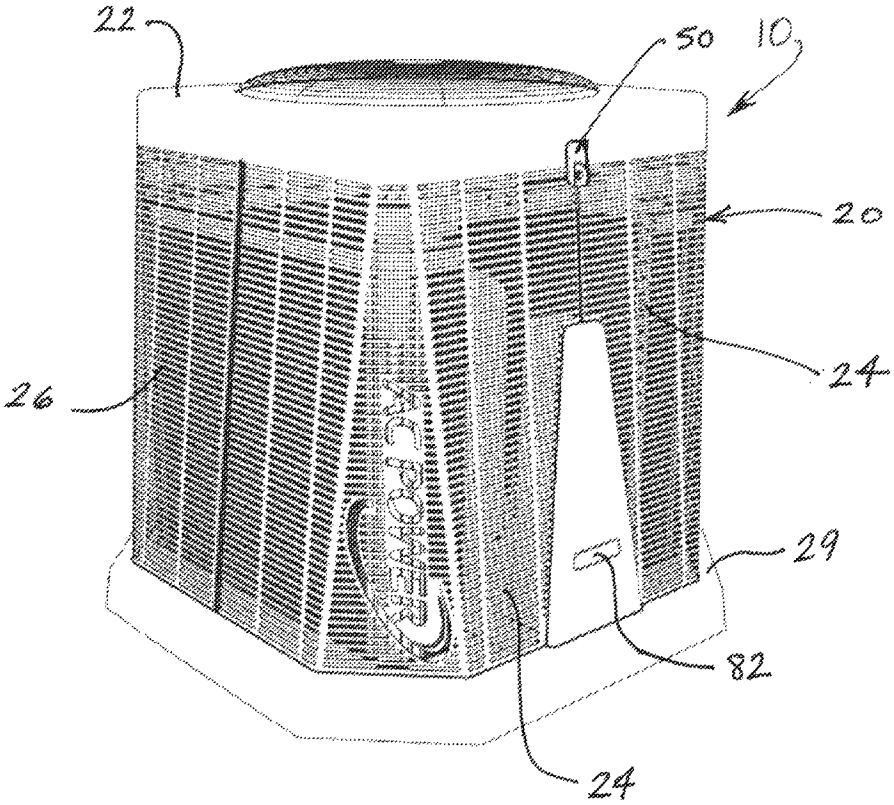
FIG. 1 is a front, top perspective view of the condenser unit of the present invention showing the external housing thereof.
Figure 2:
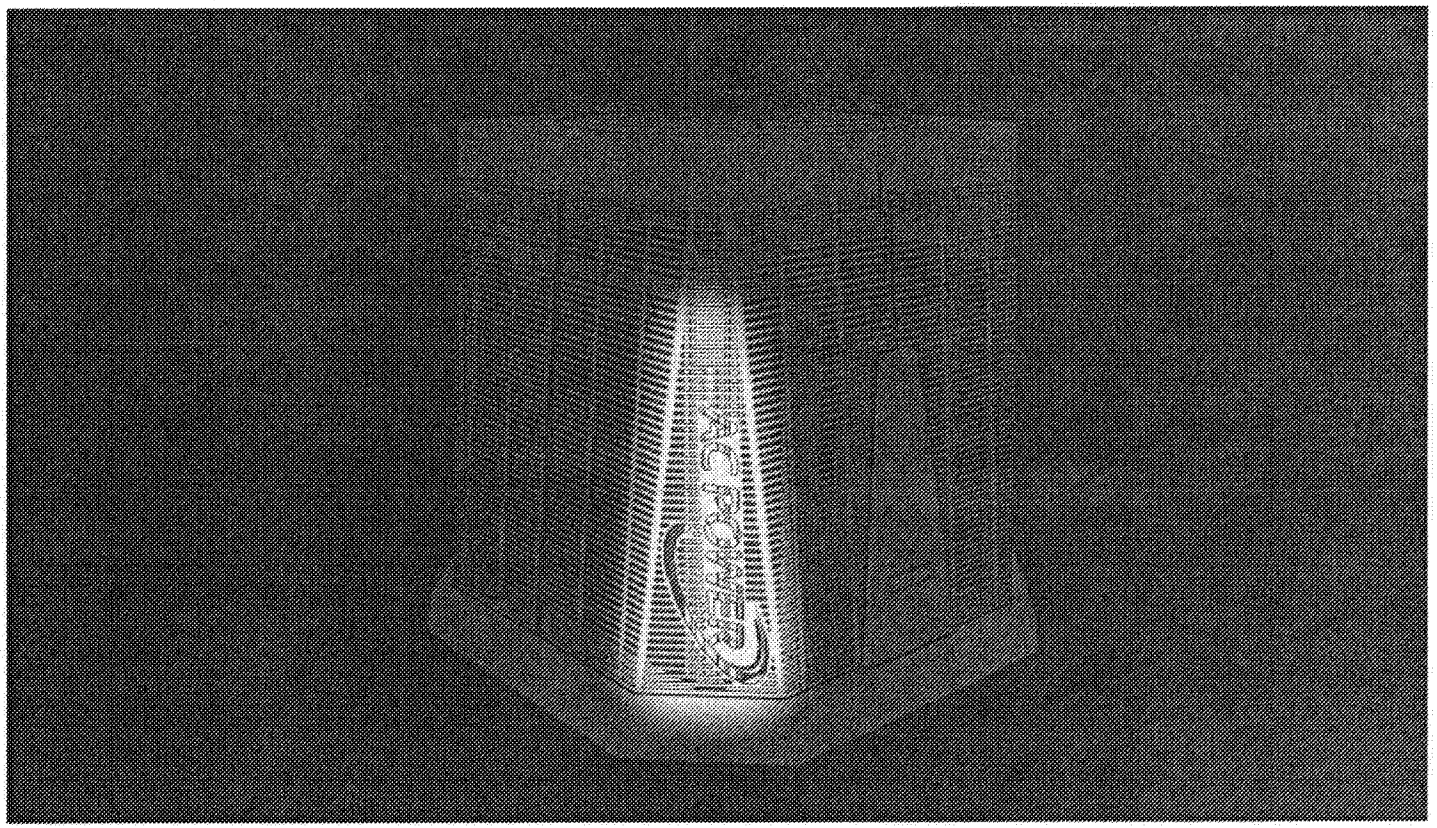
FIG. 2 is front, top perspective view of the condenser unit housing of FIG. 1 in a dark environment showing a side or corner panel thereof illuminated to indicate a particular status of the condenser unit such as cooling, standby mode or a malfunction.

The condenser unit of the present invention is shown throughout the several views of the drawings and is generally indicated as 10. The condenser unit 10 features LED illumination to indicate the status of operation. Specifically, when the condenser unit is powered and cooling, the LEDs glow blue, as see in FIG. 1. The LEDs will turn green when the condenser unit is standby mode, indicating that the unit is functioning but not currently cooling. The LEDs will turn red if the unit is malfunctioning, and the LEDs will be off when the condenser unit is not receiving power. Illumination also helps with locating and servicing the condenser unit 10 at night, as shown in FIG. 2.

Figure 3:
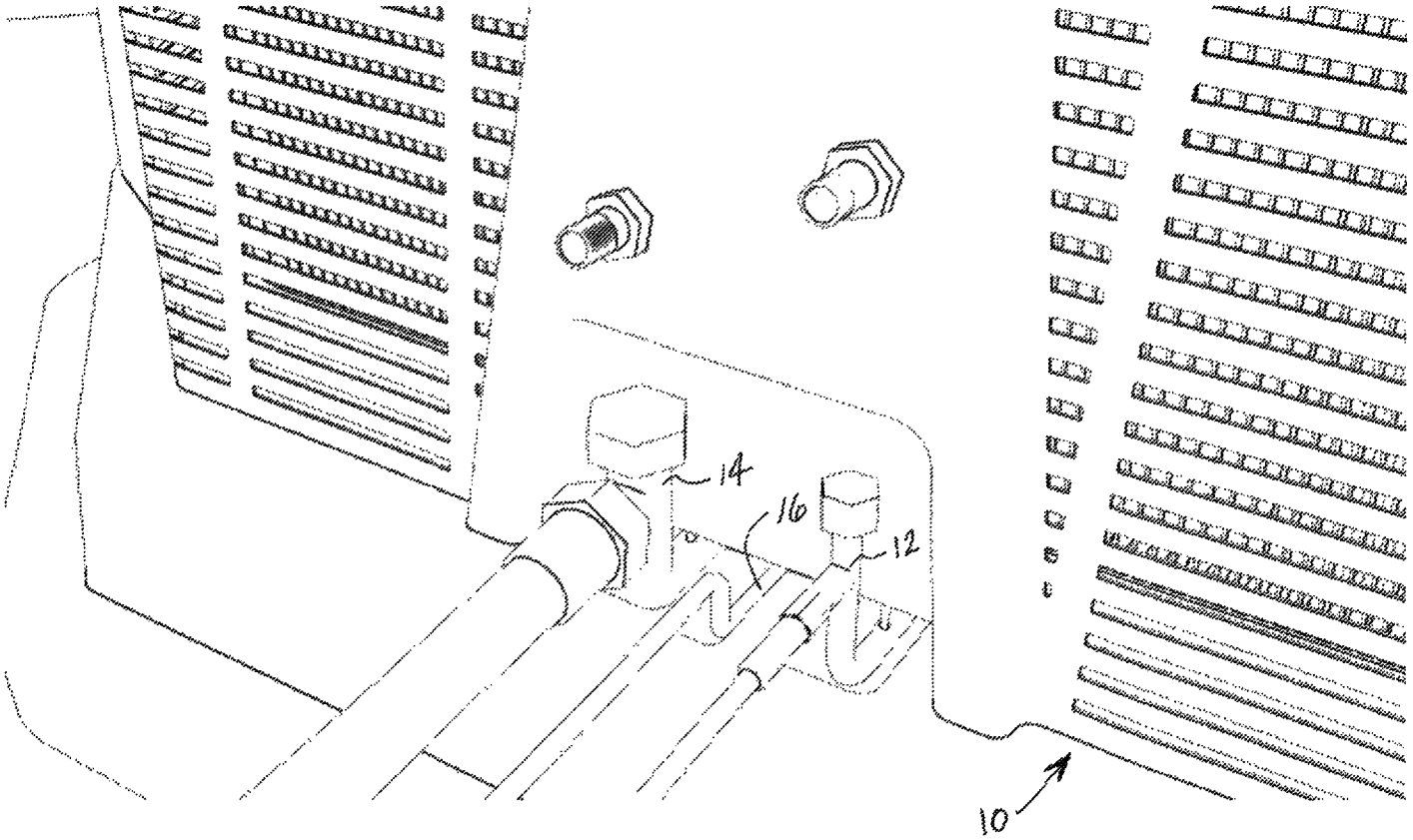
FIG. 3 is an isolated perspective view showing service valves on the condenser unit for liquid and suction lines.

Referring to FIG. 3, service valves for liquid and suction lines are located separately, making it easier to attach and read the pressure gauges. High pressure is indicated as 12, low pressure is indicated as 14, and power is indicated as 16.

Figure 4:
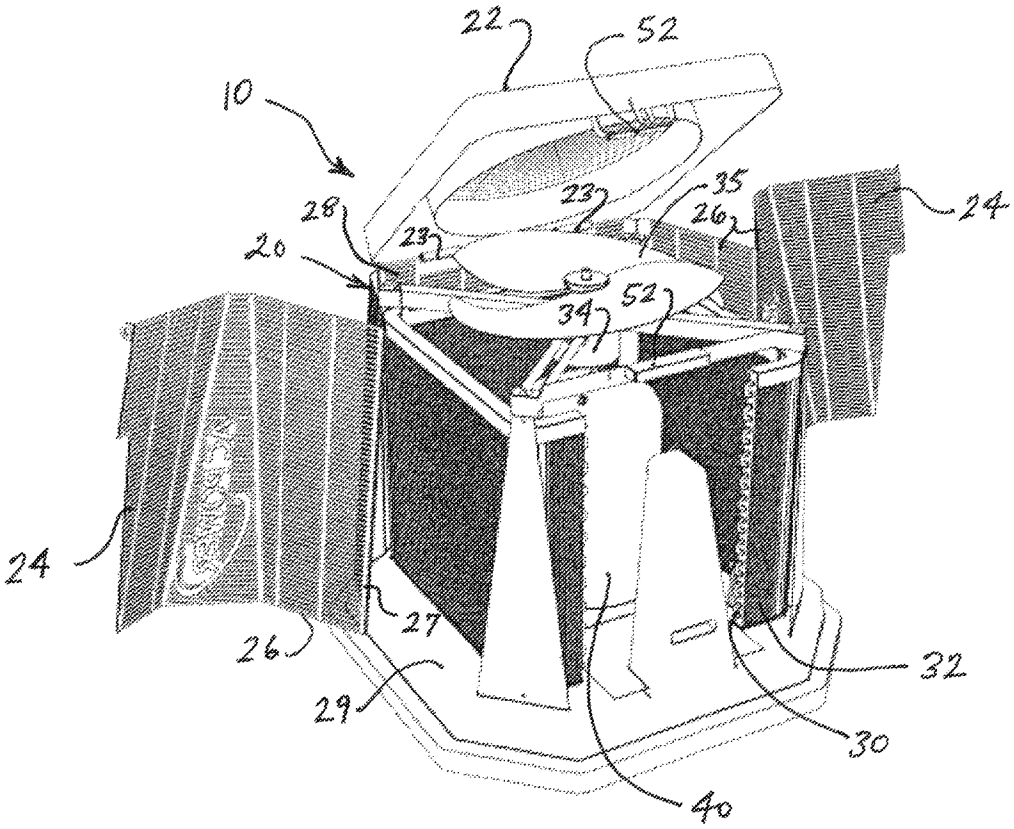
FIG. 4 is a front, top perspective view of the condenser unit of the present invention shown with the lid, front and side panels hinged open for cleaning, service or repairs.
Figure 5:
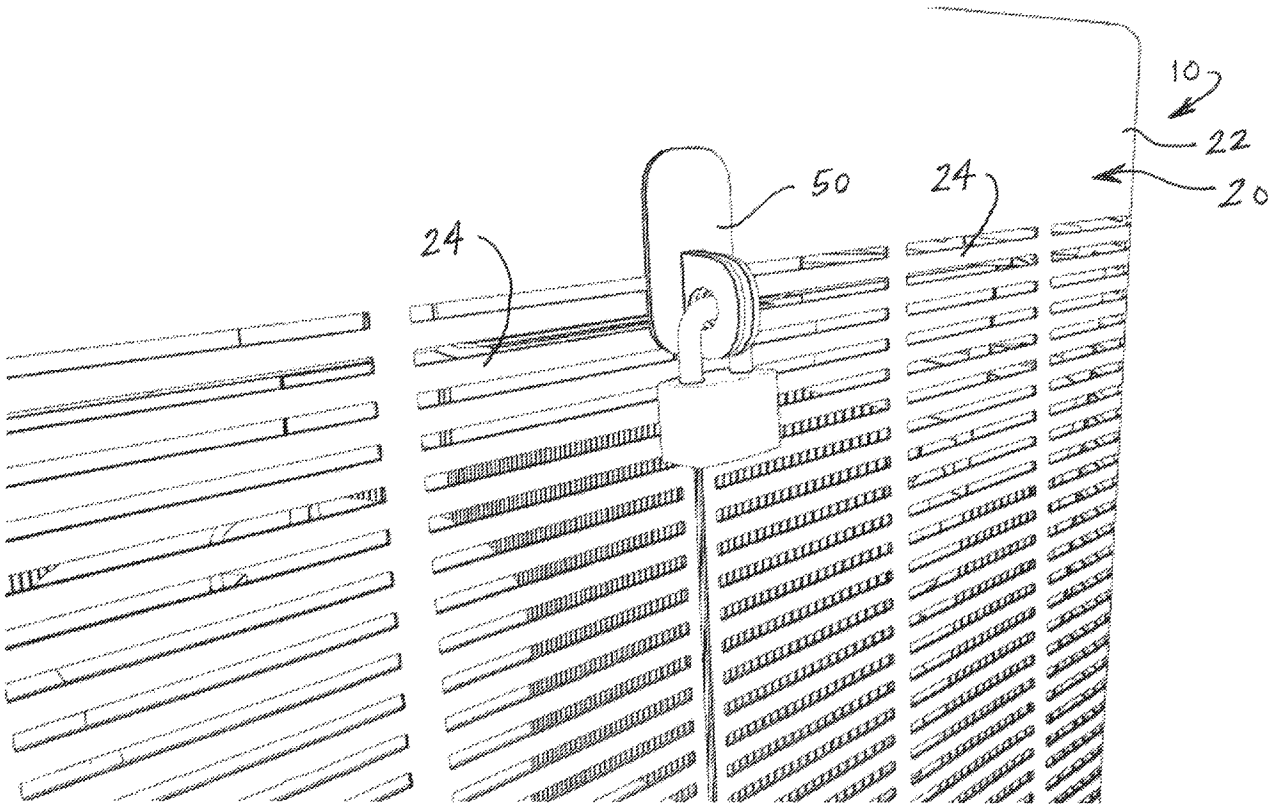
FIG. 5 is an isolated perspective view showing a padlock hasp for securing the lid and side panels closed with the use of a padlock.
Figure 6:
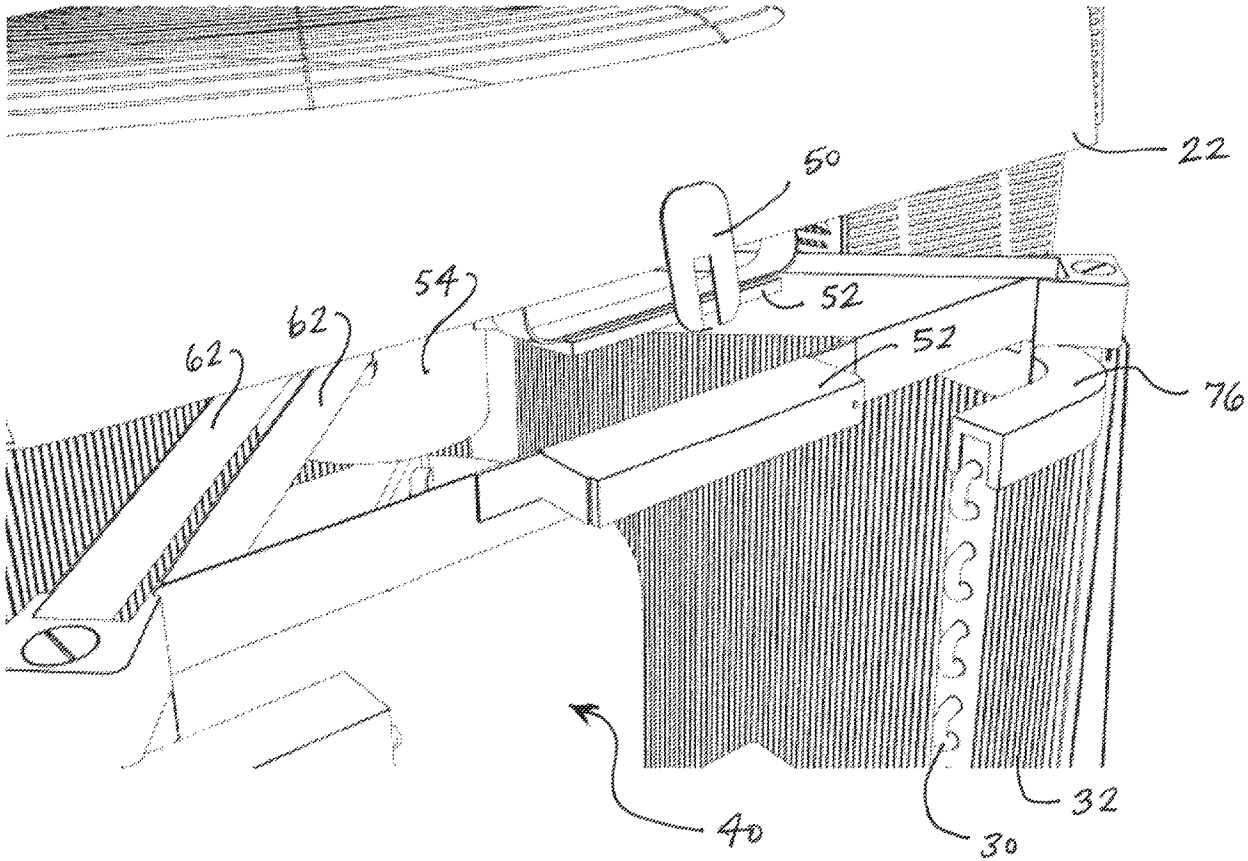
FIG. 6 is an isolated perspective view showing the lid partially opened and showing an electromagnetic lock for locking the lid closed during normal operation.

The condenser unit 10 includes a protective housing 20 that surrounds the condenser coil 30, coil fins 32, exhaust fan including a fan motor 34 and fan blade 35, compressor 40 and electrical components and connections. The housing 20 includes a top lid 22, front panels 24, side panels 26, back panel 28 and base 29. The lid 22, front panels 24, and side panels 26 are hinged, and open to allow coil cleaning, as seen in FIG. 4. The lid 22 uses spring hinges 23, allowing it to open and stay open by itself. The side panels 26 and front panels 24 are connected by piano hinges 27. The condenser unit lid 22 includes a padlock hasp 50 that allows the lid 22 to be locked to the front panels 24 when the lid is closed, thereby preventing tampering (FIG. 5). As seen throughout the several views of the drawings, the front panels 24, side panels 26 and back panel 28 are all provided with an arrangement of slot openings to allow air to pass therethrough. Additionally, the lid 22 has a protective wire screen for covering the fan blade while allowing forced airflow therethough. The lid 22 also includes an electromagnetic lock (EM) 52 to keep it closed, preventing the unit from being opened when it is powered (see FIG. 6) as a safety measure. When the fuse is pulled out of the disconnect box, the EM lock 52 loses power and the lid 22 opens for servicing the unit 10.

Figure 7:
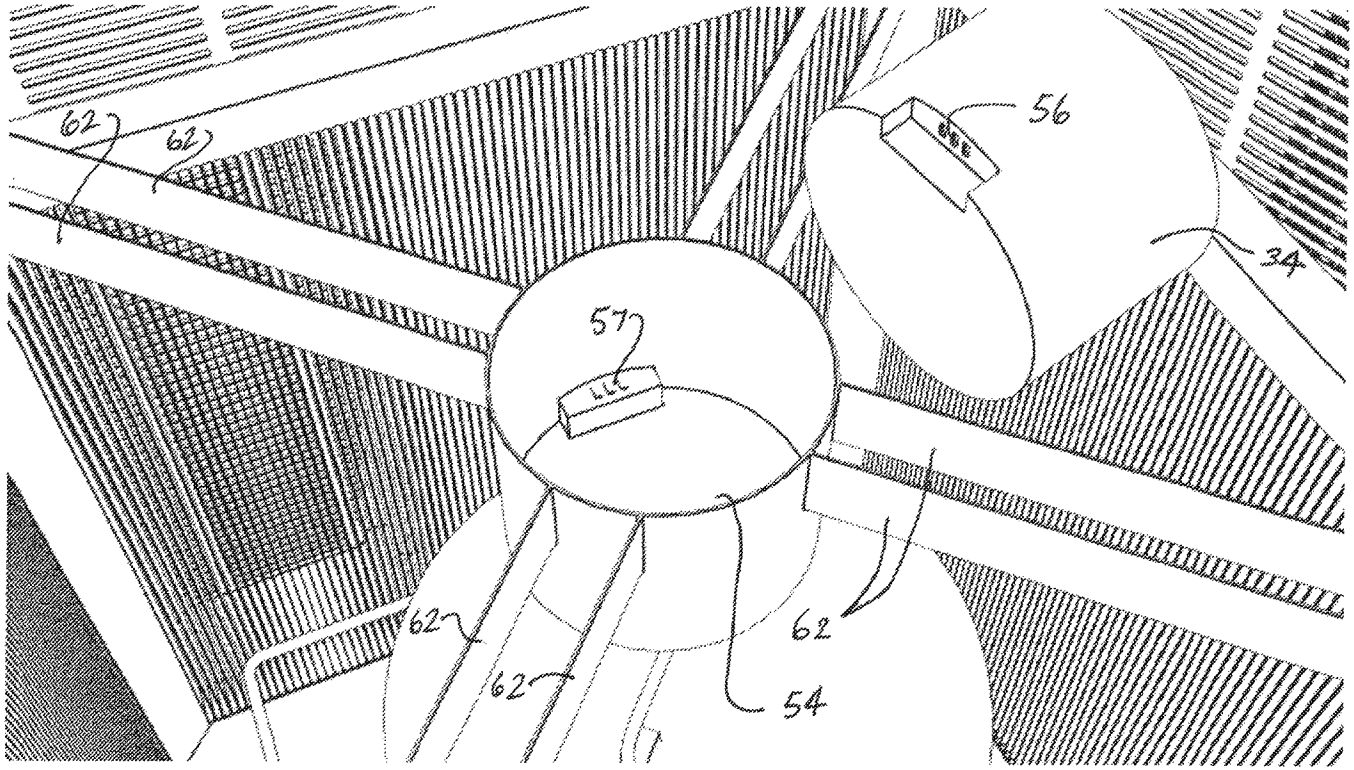
FIG. 7 is an isolated, top perspective view showing a fan motor bracket, fan motor socket and fan motor removed from the fan motor socket.
Figure 8:
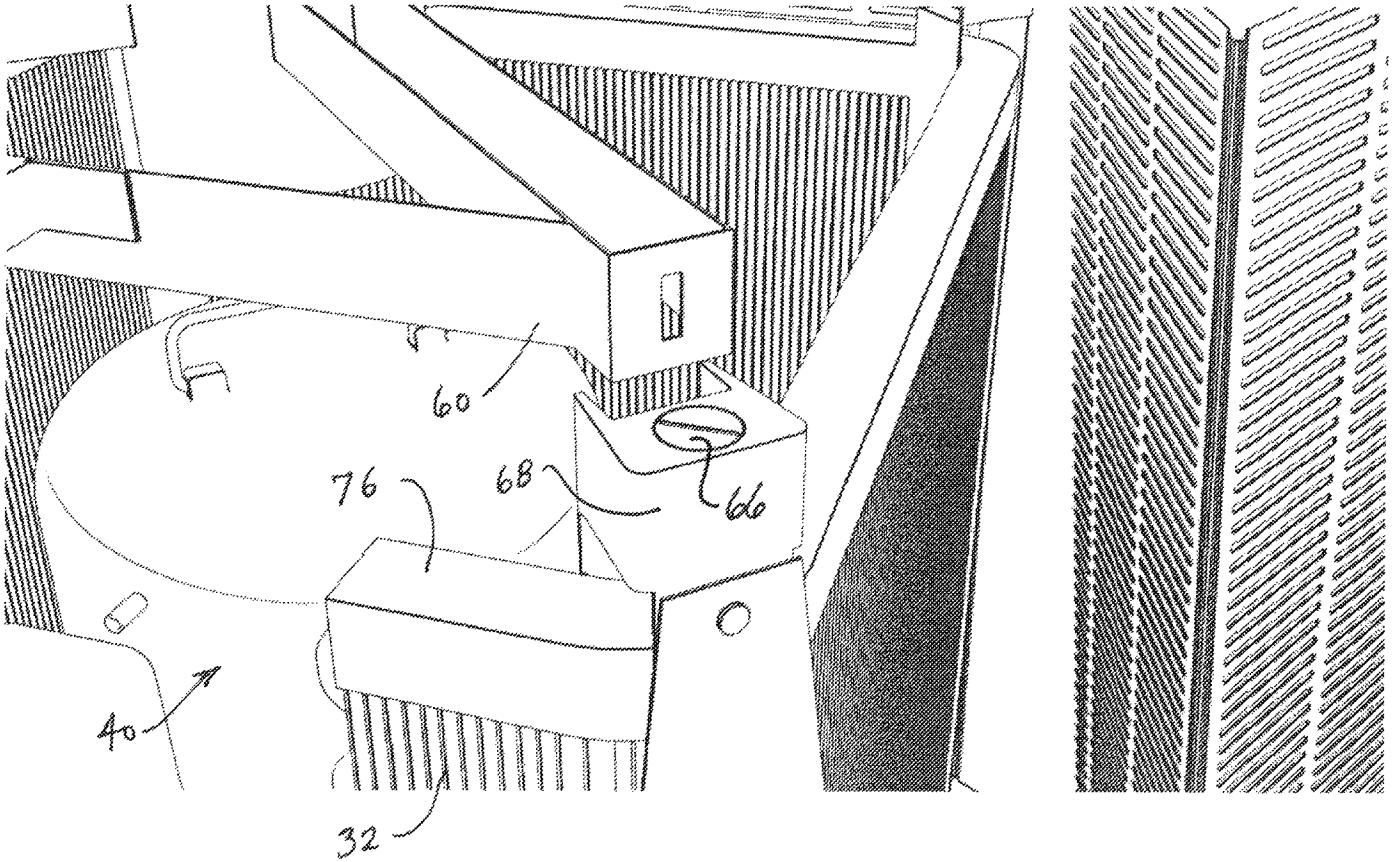
FIG. 8 is an isolated perspective view showing one extension of the fan motor bracket removed from a corner frame structure of the condenser unit base.
Figure 9:
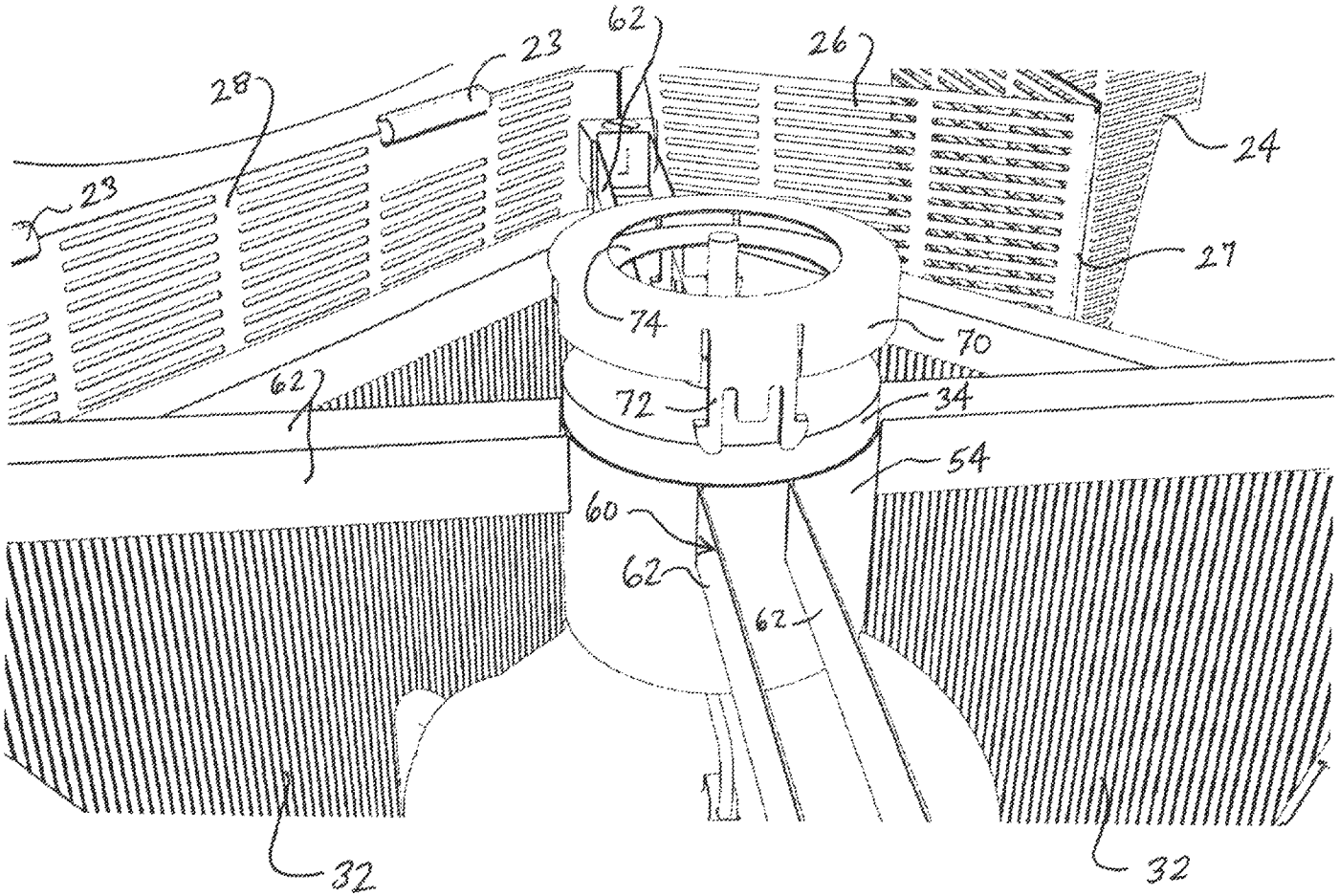
FIG. 9 is an isolated perspective view showing the fan motor being fastened within the fan motor socket on the bracket with a seal cap that has releasable locking clips that lockingly engage with the fan motor bracket.
Figure 10:
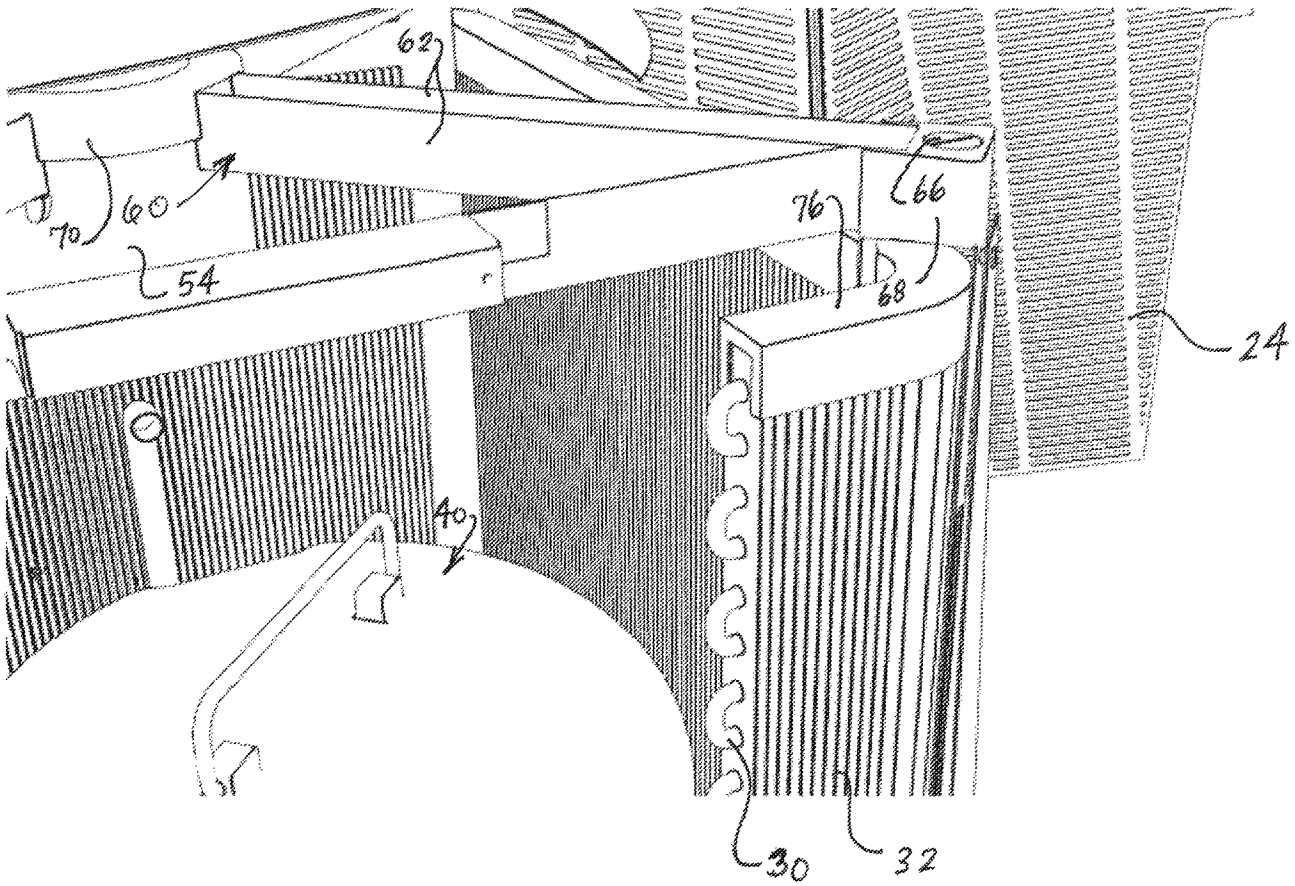
FIG. 10 is an isolated perspective view showing the coil fins protected by a removable molded rubber seal that follows the contour of the coil fins of the condenser unit.

Referring to FIG. 7, the fan motor 34 has metal contacts 56 that engage with electric contacts 57 in the fan motor socket. The fan motor 34 is only powered when it is sitting in the fan motor socket 54. The motor 34 is not connected by any wires. The motor socket metal contacts 57 and EM lock both receive power by wire, easily connected and disconnected. The fan bracket 60 includes struts 62 that support the motor socket 54. The bracket 60 is easy to unlock with use of a flathead screwdriver (see FIG. 8). There are latches 66 at the four corners 68 of the condenser unit base, and the fan bracket sits in all four corners with the EM lock facing the front. As seen in FIG. 9, the fan motor 34 is fastened to the bracket with a seal cap 70 that has two clips 72 that releasably engage with the struts 62 of the fan motor bracket 60. A rubber seal 74 on the inside of the seal cap 70 prevents moisture from getting inside the fan motor 34. The coil fins 32 are protected by a removable molded rubber seal 76 that follows the contour of the top end of the coil fins 32 (see FIG. 10).

Figure 11:
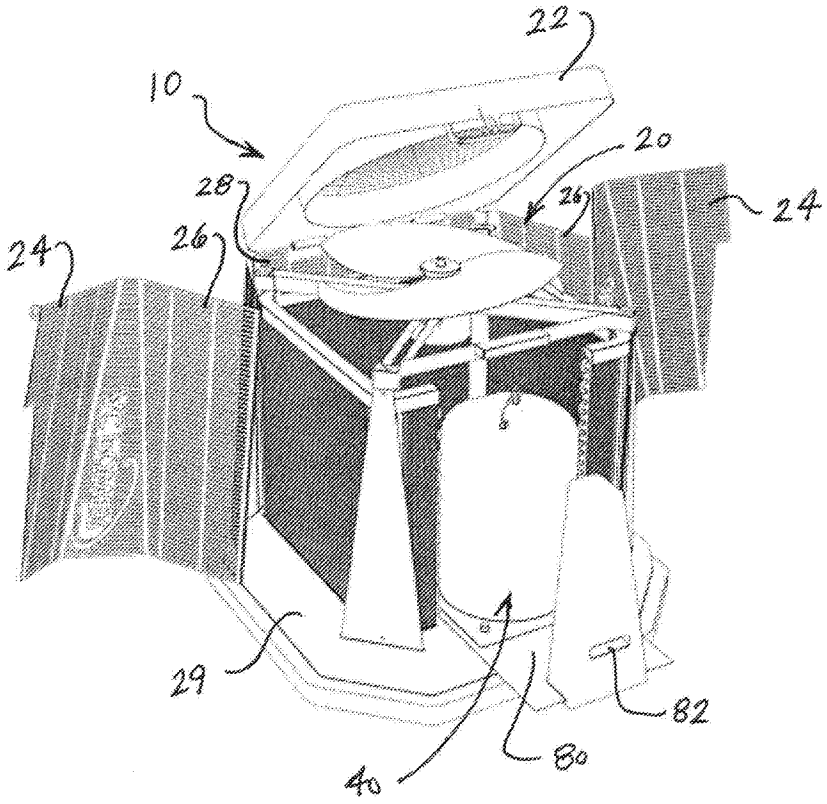
FIG. 11 is a front, top perspective view of the condenser unit shown with the lid, side panels and front panel hinged open and a compressor plate supporting the compressor unit pulled out by the aid of ball bearing rollers below the compressor plate.
Figure 12:
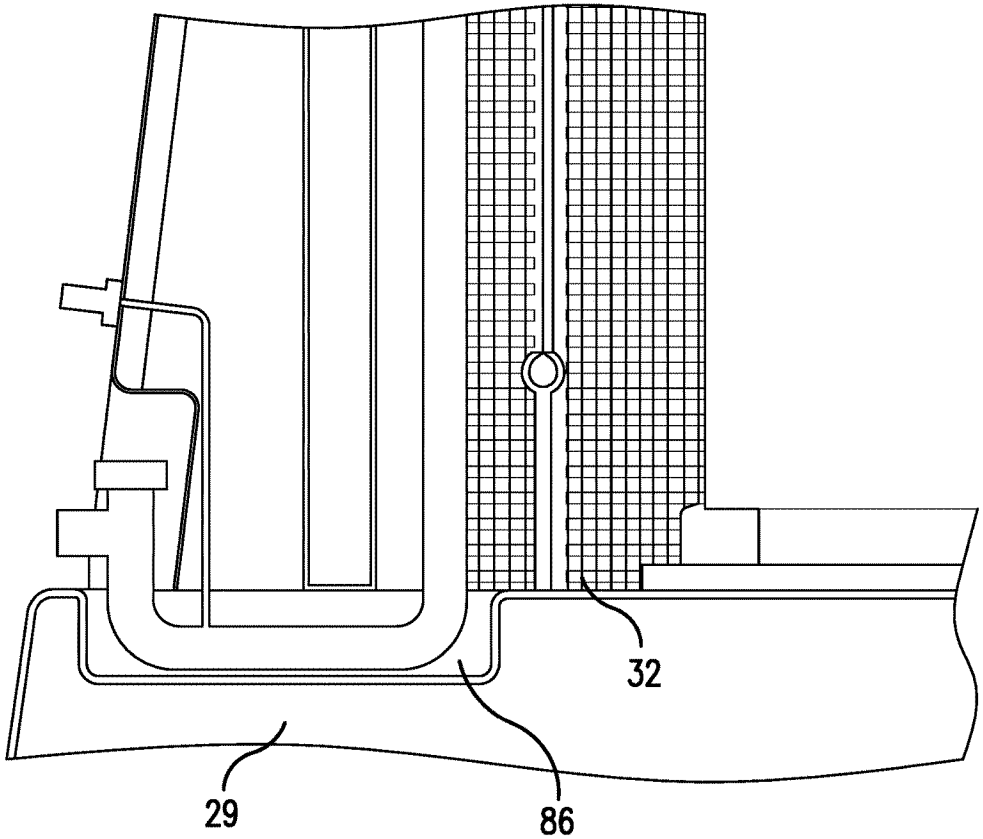
FIG. 12 is an isolated side elevational view showing channels in the base of the condenser unit for passage of liquid lines, suction lines and electric conductors to pass therethrough.
Figure 13:
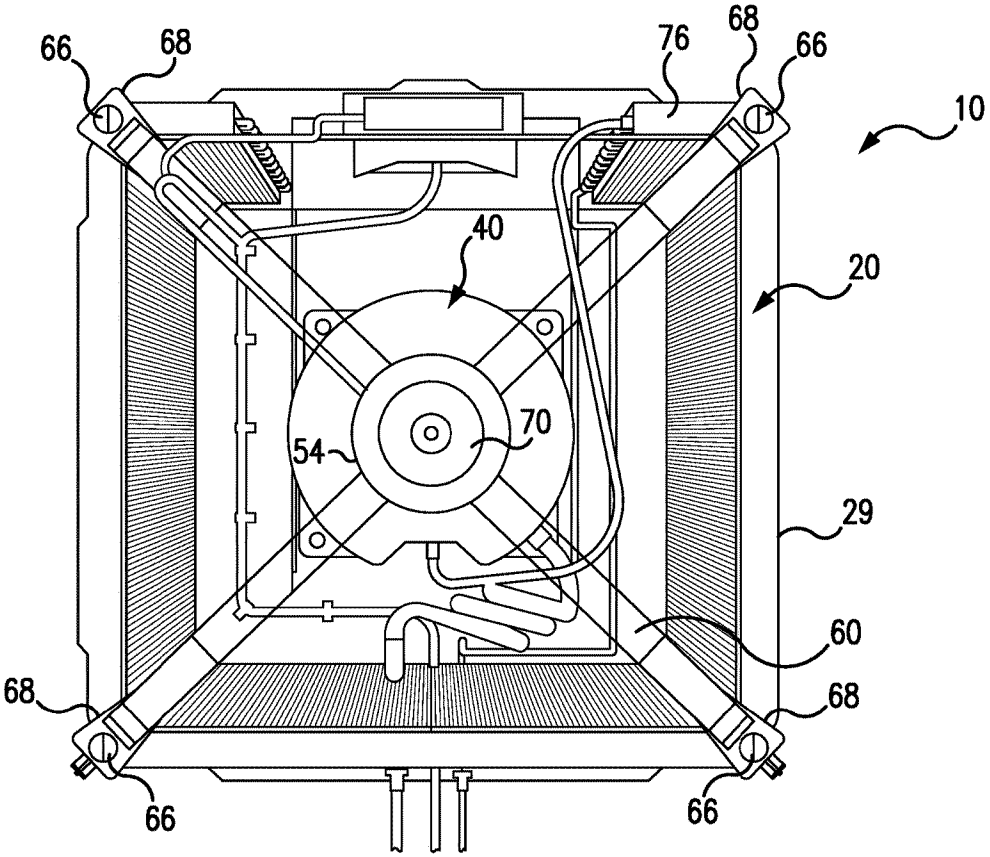
FIG. 13 is a top plan view of the condenser unit with the lid removed.
Figure 14:
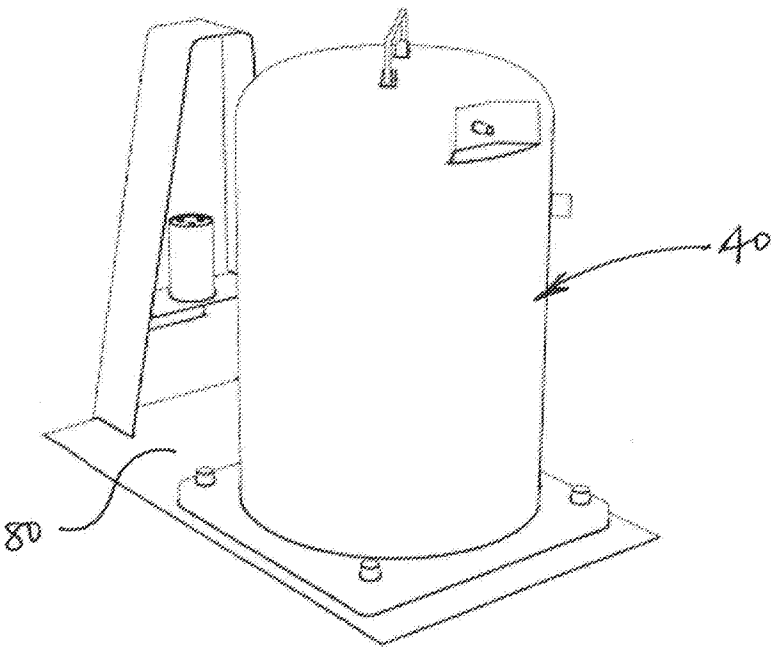
FIG. 14 is an isolated perspective view showing the compressor supported on the sliding compressor plate.
Figure 15:
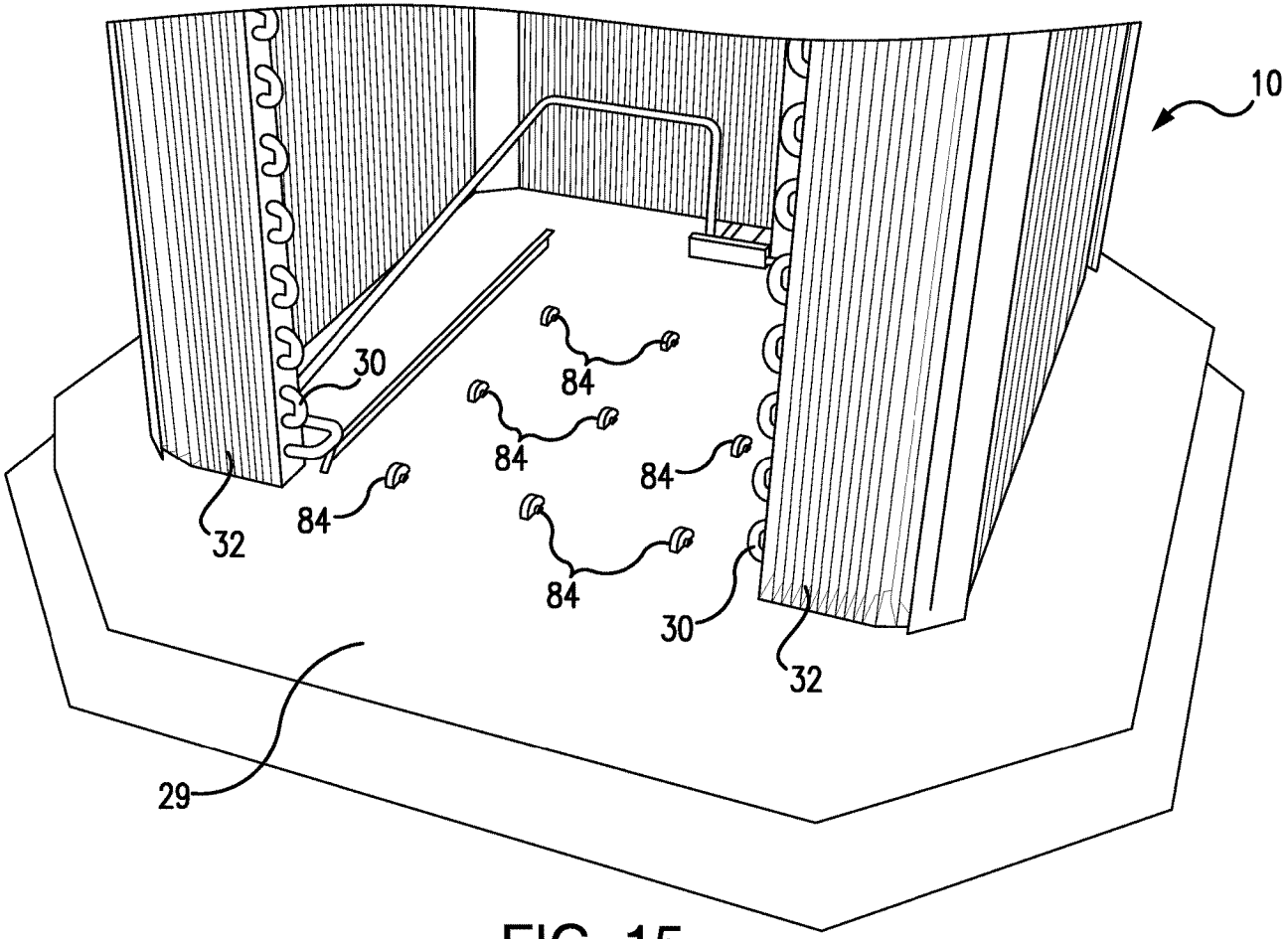
FIG. 15 is an isolated perspective view showing ball bearing rollers on the floor of the compressor unit base for engaging the underside of the compressor plate allowing the compressor plate to slide out from the compressor unit housing in a smooth and easy manner.

The compressor 40 is supported on a plate 80 that has a hand pull 82, and slides out, aided by ball bearing rollers 84, as seen in FIG. 11. This makes changing out the compressor 40 much easier. Both liquid and suction lines (i.e., hoses) are coiled, and are long enough, allowing compressor 40 to slide out while the hoses remain attached. Referring to FIG. 12, channels 86 in the base 29 allow liquid and suction lines and electricity to pass under the coil fins 32 to the compressor 40 and electrical components. As shown in FIG. 13, the compressor 40 connects to the suction and liquid valves, and condenser coil via coiled flexible high-pressure neoprene hoses. The electrical wiring is routed through and held up by brightly-colored stakes. The electronic components are contained within sliding compressor plate 80 (see FIG. 14). The array of ball bearing rollers 84 under the compressor plate 80 (FIG. 15) helps the compressor plate 80 to slide out of the condenser unit housing 20 smoothly.

Figure 16:
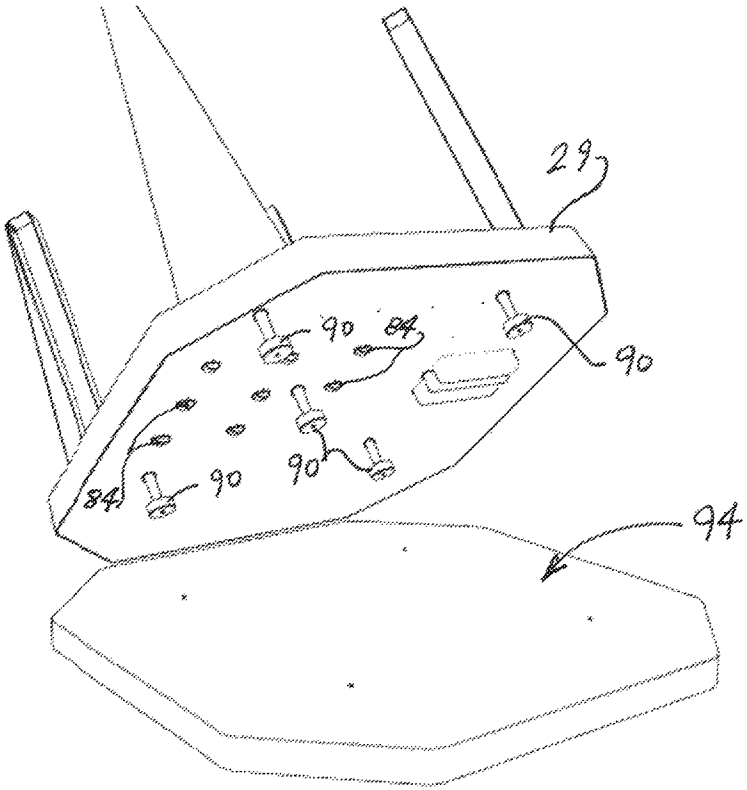
FIG. 16 is a perspective view showing internal tie down channels on the base of the condenser unit and rubber pads that are sandwiched between the condenser unit base and a concrete pad for absorbing vibrations.
Figure 17:
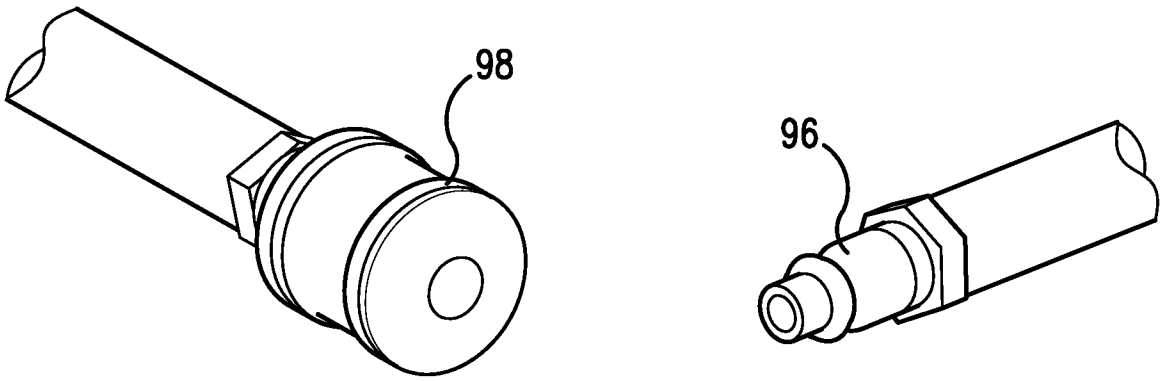
FIG. 17 is an isolated perspective view showing a female end connector and a male end connector of quick release fittings on internal hoses of the condenser unit.

Referring to FIG. 16, internal tie down channels safeguards against theft and tampering. Rubber pads 90 are sandwiched between the condenser unit base 29 and the concrete pad 94, absorbing vibrations. The base 29 is fastened to the concrete pad 94 using heavy duty, corrosion-resistant bolts. All internal hoses have corresponding quick release male and female fittings 96, 98 that can be released by hand (see FIG. 17).

While the present invention has been shown and described in accordance with a preferred and practical embodiment thereof, it is recognized that departures from the instant disclosure are fully contemplated within the spirit and scope of the present invention which is not to be limited except as defined in the following claims.

What is claimed is:

1. A condenser unit for an air conditioning system comprising:

a compressor;

a condenser coil;

an exhaust fan including a fan motor and fan blade;

a condenser housing surrounding the compressor, condenser coil and exhaust fan, and said condenser housing including a base, a top lid and a plurality of vertical panels extending upwardly between the base and the top lid, and at least some of the plurality of vertical panels and the top lid being structured for hinged movement to allow the condenser housing to be at least partially opened to facilitate access to the condenser coil, compressor and exhaust fan;

a fan motor socket structured and disposed for removably receiving and supporting the fan motor therein, and the fan motor and the fan motor socket including cooperating electrical contacts for providing an electrical connection between the fan motor socket and the fan motor for supplying electrical power to the fan motor;

a fan motor bracket for supporting the fan motor socket, and the fan motor bracket including a plurality of struts connecting to and supporting the fan motor socket;

a seal cap for fastening the fan motor within the fan motor socket, the seal cap being structured and disposed for engaging at least a portion of a top surface of the fan motor, and the seal cap including a plurality of clips structured to releasably engage the struts of the fan motor bracket with the seal cap fitted over and engaging the top of the fan motor for holding the fan motor within the fan motor socket;

coil fins surrounding the condenser coil and the coil fins including top edges;

a removable rubber seal having a U-shaped cross-sectional configuration and being structured and disposed to fit over and completely cover the entire top edges of the coil fins and to extend partially down front and rear sides of the coil fins to cover an upper portion of the front and rear sides of the coil fins, and the rubber seal being further structured and disposed to follow the contour of the top edges of the coil fins to protect the top edges and the upper portion of the front and rear sides of the coil fins when the top lid of the condenser housing is both hinged open and closed; and a sliding plate within the condenser unit for supporting the compressor, and the sliding plate being structured and disposed to be moved at least partially outward from the condenser housing when at least one of the plurality of vertical panels are hinged open.

2. The condenser unit as recited in claim 1 further comprising:

an electromagnetic lock for securing the top lid of the condenser housing closed and locked with the plurality of vertical panels when the condenser unit is electrically powered and operational.

3. The condenser unit as recited in claim 1 wherein the plurality of vertical panels include at least one front panel, opposite side panels and a back panel all extending upwardly between the base and the top lid.

4. The condenser unit as recited in claim 3 wherein the at least one front panel, opposite side panels and back panel each include an arrangement of openings therethrough to allow airflow through the condenser housing and around the condenser coil.

5. The condenser unit as recited in claim 1 wherein the sliding plate supporting the compressor is movable on roller bearings fitted to the base of the condenser unit housing.

6. The condenser unit as recited in claim 1 further comprising:

a rubber seal on an inside of the seal cap for discouraging entry of moisture into the fan motor.

* * * * *